US005409172A

United States Patent [19]

Lesar

[11] Patent Number: 5,409,172

[45] Date of Patent: Apr. 25, 1995

[54] SYSTEM FOR REMOVING A KNIFE INSERT FROM THE KNIFE HOLDER OF A GRINDER

[75] Inventor: Nick J. Lesar, Palmyra, Wis.

[73] Assignee: Weiler and Company, Inc., Whitewater, Wis.

[21] Appl. No.: 119,282

[22] Filed: Sep. 9, 1993

[51] Int. Cl.[6] ..... B02C 11/04

[52] U.S. Cl. ..... 241/292.1; 83/954

[58] Field of Search ..... 241/292.1; 83/698, 954, 83/955, 698.41

*Primary Examiner*—Douglas D. Watts

*Attorney, Agent, or Firm*—Andrus, Sceales, Starke & Sawall

[57] ABSTRACT

A knife insert for use with a knife holder of a grinder, such as a meat grinder, is adapted to be positioned within a slot formed in the knife holder. The knife insert extends outwardly from the outer end of the knife holder, and a beveled edge is formed adjacent the outer end of the knife insert. The beveled edge is adapted to be engaged by a punch, which is struck such as by a hammer to dislodge the knife insert from the knife holder when it is desired to change knife inserts. The beveled edge enables the punch to be held at an angle relative to the knife holder and the adjacent components of the grinder, to allow the punch to easily be held in place. The hammer, which is used to apply the striking force to the punch, can easily be swung clear of the components of the grinder head to facilitate easy and quick removal of the knife insert.

5 Claims, 1 Drawing Sheet

FIG. 1
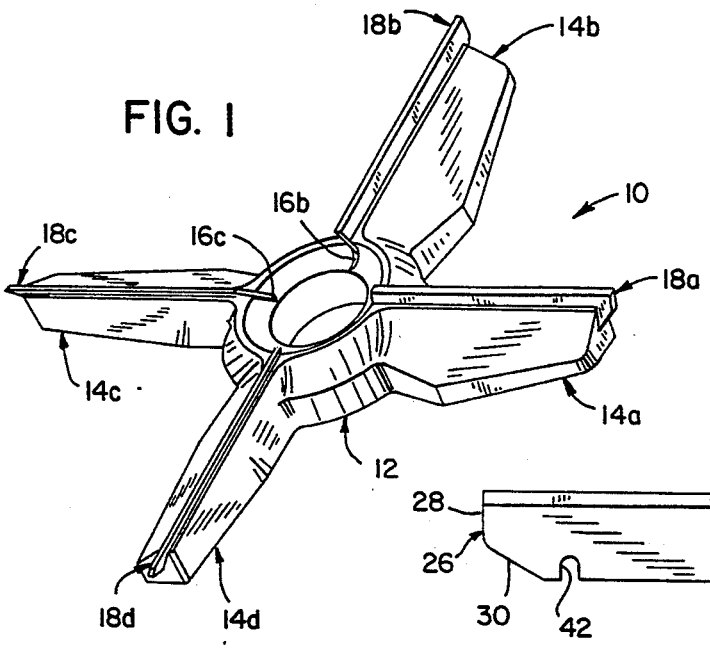
FIG. 2
(PRIOR ART)
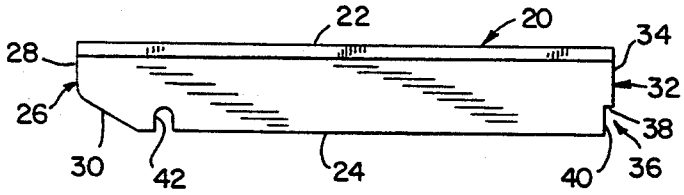
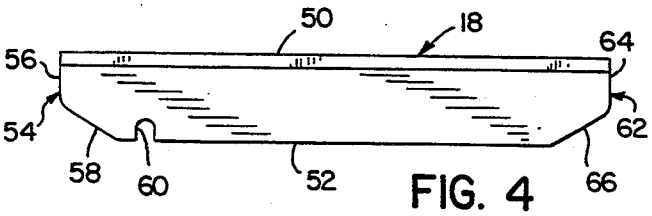
FIG. 4
FIG. 3
(PRIOR ART)
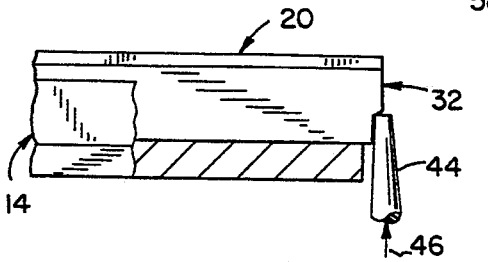
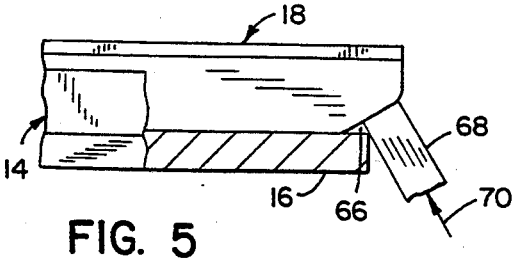
FIG. 5
FIG. 6
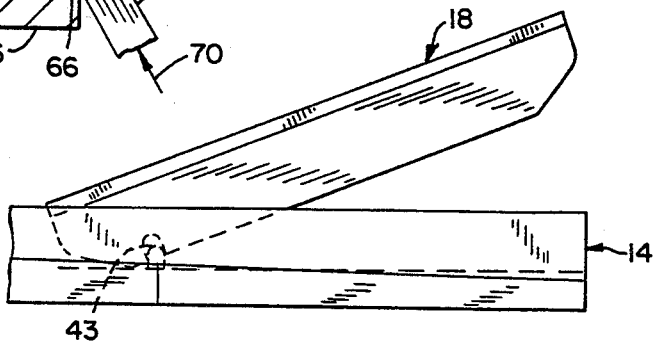

SYSTEM FOR REMOVING A KNIFE INSERT FROM THE KNIFE HOLDER OF A GRINDER

BACKGROUND AND SUMMARY OF THE INVENTION

This invention relates to a grinder which employs a rotating knife assembly in combination with an orifice plate or the like, and more particularly to a system for removing knife inserts from the knife assembly.

A heavy duty grinder, such as a meat grinder, typically includes a housing having an outlet, with an orifice plate being mounted to the housing at its outlet. The material to be ground is forced through the housing toward the outlet, such as by a rotating auger. A knife assembly, which generally consists of a knife holder having a series of knife inserts mounted thereto, is rotatably mounted adjacent the inside surface of the orifice plate such that the knife inserts bear against the orifice plate during rotation of the knife assembly. Typically, the knife assembly is mounted to the end of the auger, and rotates along with the auger to sever the material as it is being forced into and through the individual orifices of the orifice plate.

The knife holder includes slots within which the knife inserts are received. The knife inserts wear relatively rapidly, and it is necessary to frequently change the knife inserts during operation of the grinder. Typically, a buildup of material occurs within the knife holder slots, which makes it difficult to remove the knife inserts prior to installation of replacement inserts.

The knife holder typically includes a series of radial arms extending outwardly from a hub, with each arm terminating in an outer end. A slot is formed in each knife holder arm, opening onto the outer end of each arm. In the past, the knife insert has extended outwardly of the outer end of each arm, and a notch has been formed in the knife insert. The notch defines a striking surface parallel to the longitudinal axis of the knife insert. To remove the knife insert, a punch has been engaged with the striking surface defined by the notch and the punch has been struck, such as by using a hammer or the like, to break the knife insert free from the material accumulated within the slot to remove the knife insert from the slot. The orientation of the striking surface on the knife insert has made it difficult to accurately position the punch and to allow an accurate swing of the hammer with sufficient force to quickly and easily break the knife insert free.

It is an object of the present invention to provide a knife insert structure which facilitates removal of the knife insert from the knife holder when changing knife inserts, using a conventional knife holder and without providing a departure from the manner in which the knife inserts are mounted to the knife holder. Another object of the invention is to provide a quick and easy method of removing the knife inserts from the knife holder.

In accordance with one aspect of the invention, a knife insert for a grinder defines a forward edge extending outwardly of the knife holder slot, a rearward edge disposed within the slot, and inner and outer ends. The knife insert extends along a longitudinal axis, and includes a beveled edge oriented non-parallel to the longitudinal axis. The beveled edge forms at least a part of the outer end of the knife insert. The beveled edge is adapted to be engaged by a striking tool having its longitudinal axis oriented non-perpendicular to the longitudinal axis of the knife insert for use in removing the knife insert from the slot. The outer end of the knife insert further includes an outer edge which extends rearwardly from the forward edge, and the beveled edge extends between the rearward edge and the outer edge. Preferably, the beveled edge is oriented at an angle of approximately 30° relative to the rearward edge. The knife insert extends outwardly from the outer end of the knife holder arm to which it is mounted. The beveled edge of the knife insert is formed so as to extend inwardly from the outer end of the knife holder into the slot. With this arrangement, the end of the striking tool is engaged with the beveled edge and the striking tool is then struck to remove the knife insert from the knife holder slot, by application of a force applied in a direction substantially perpendicular to the beveled edge. The striking tool can thus be positioned so as to extend outwardly away from the knife holder, to facilitate engagement of the tool with the beveled edge and striking of the tool with a hammer or the like. No modifications to the knife holder structure are necessary in order to accommodate the improved knife insert and to facilitate its removal from the knife holder.

The invention also contemplates a method of removing a knife insert from the knife holder of a grinder, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view showing a knife holder for use with a grinder, to which knife inserts constructed according to the invention are mounted;

FIG. 2 is an elevation view of a prior art knife insert adapted for use with a knife holder similar to that shown in FIG. 1;

FIG. 3 is a partial elevation view, with portions broken away, showing the prior art knife insert of FIG. 2 as installed within a knife holder such as shown in FIG. 1 and showing the manner in which the knife insert is removed;

FIG. 4 is a view similar to FIG. 2, showing a knife insert constructed according to the invention and adapted for use in combination with the knife holder of FIG. 1;

FIG. 5 is a view similar to FIG. 3, showing the knife insert of FIG. 4 mounted to the knife holder as in FIG. 1 and showing the manner in which the knife insert is removed; and FIG. 6 is a partial elevation view showing removal of the knife insert of FIGS. 4 and 5 from the knife holder.

DETAILED DESCRIPTION OF THE INVENTION

FIG. 1 illustrates a knife assembly, shown generally at 10, adapted for use in a heavy duty grinder, such as a meat grinder or the like. Knife assembly 10 consists of a knife holder having a hub 12 and a series of arms extending therefrom, shown at 14*a*, 14*b*, 14*c* and 14*d*. The knife holder may be that such as is shown and described in pending U.S. application Ser. No. 07/778,010, filed Oct.

17, 1991, the disclosure of which is hereby incorporated by reference.

Arms 14a–14d are identical in construction. Each of arms 14a–14d is provided with a slot extending from hub 12 throughout its length, opening onto the outer end of each arm. The slots in arms 14a–14d are shown at 16a–16d, respectively. Knife inserts, such as shown at 18a–18d, are mounted within slots 16a–16d, respectively, in arms 14a–14d. Each of slots 16a–16d is slanted forwardly relative to the outer surface of each arm 14a–14d onto which the slot opens, such that knives 18a–18d are slanted forwardly in the direction of rotation of knife assembly 10.

FIG. 2 illustrates the structure of a prior art knife insert shown at 20. Insert 20 is adapted for use with a knife holder identical to that shown in FIG. 1. Knife insert 20 includes a sharpened forward edge 22, a rearward edge 24 parallel to forward edge 22, an inner end 26 including an inner edge 28 and an angled edge 30 extending between inner edge 28 and rearward edge 24, and an outer end 32 including an outer edge 34 and a notch 36 defining a striking surface 38 and an edge 40 extending between striking surface 38 and rearward edge 24. Striking surface 38 is oriented parallel to the longitudinal axis of insert 20 and to forward and rearward edges 22, 24, respectively. A notch 42 is formed in rearward edge 24 adjacent angled edge 30, for receiving a pin 43 (FIG. 4) located within each of slots 16a–16d within which knife 20 is adapted to be received, for positioning knife insert 20 in a proper lateral position relative to knife arms 14a–14d, respectively.

FIG. 3 illustrates knife insert 20 engaged within the slot formed in one of arms 14a–14d, in which the arm is shown generally at 14. When it is desired to remove insert 20, an operator positions a conventional punch, the tip of which is shown at 44, such that the end of punch 44 engages striking surface 38 and punch 44 extends along a longitudinal axis substantially perpendicular to striking surface 38 and to the longitudinal axis of knife insert 20. The operator then applies a striking force to punch 44, such as by use of a hammer or the like, in the direction of an arrow 46 to dislodge knife insert 20 from the slot 16 formed in arm 14. This lifts the outer end of knife insert 20 upwardly out of slot 16 and away from arm 14. Angled surface 30 accommodates the upward lifting movement of the outer end of knife insert 20 until knife insert 20 has been moved out of slot 16 an amount sufficient to enable the operator to grasp knife insert 20 and physically pull the remaining portion of knife insert 20 out of slot 16. As noted previously, the drawback to this procedure is that it is difficult to position punch 44 in the manner shown and to enable the operator to maneuver the hammer in a manner sufficient to apply the necessary striking force to punch 44 in order to quickly and easily dislodge knife insert 20.

Referring to FIG. 4, one of knife inserts 18a–18b constructed according to the invention, shown generally at 18, includes a forward edge 50, a rearward edge 52, and an inner end 54 including an inner edge 56 and an angled surface 58 extending between inner edge 56 and rearward surface 52. A notch 60 extends inwardly into knife insert 18 from rearward edge 52. This portion of knife insert 18 is substantially identical to the analogous portions of knife insert 20 as described previously.

The outer end of knife insert 18, shown at 62, consists of an outer edge 64 and a beveled edge 66. Outer edge 64 extends rearwardly from forward 50, substantially perpendicular thereto, approximately one-half the height of knife insert 18. Beveled edge 66 extends between outer edge 64 and rearward edge 52, with a radius being formed between outer edge 64 and beveled edge 66. Beveled edge 66 is oriented at an angle of approximately 30° relative to rearward edge 52.

FIG. 5 illustrates the manner in which knife insert 18 is mounted to one of arms 14a–14d, shown generally at 14. As with knife insert 20, outer end 62 of knife insert 18 extends outwardly beyond the outer end of arm 14. Beveled edge 66 extends inwardly within slot 16.

When it is desired to remove knife insert 18, the flat end of a punch 68 is positioned against beveled edge 66. Punch 68 is relatively thin, allowing it to fit within slot 16 and to provide a significant amount of contact with beveled edge 66. Additionally, engagement of punch 68 within slot 16 functions to positively retain punch 68 in alignment with beveled edge 66. Punch 68 is then struck using a hammer or the like to apply a force along the direction of arrow 70, to dislodge knife insert 18 from slot 16 in knife arm 14. Punch 68 thus exerts a force on knife insert 18 in a direction non-perpendicular to the longitudinal axis of knife insert 18. Punch 68 is continued to be struck until knife insert 18 attains a position as shown in FIG. 6, in which the outer end of knife insert 18 is lifted out of slot 16 sufficiently to allow the operator to grasp knife insert 18 and draw it out of slot 16 using manual force. Again, as with knife insert 20, angled surface 58 accommodates such upward movement of the outer end of knife insert 18.

Punch 68 can be easily positioned as shown in FIG. 5, enabling an operator to retain the punch in position without interference from the remaining components of the grinder head to which knife assembly 10 is adjacent. Further, the hammer which is swung to strike punch 68 is clear of all components of the grinder head, allowing an operator a clear and easy swing at punch 68 in order to easily remove knife insert 18.

Various alternatives and embodiments are contemplated as being within the scope of the following claims particularly pointing out and distinctly claiming the subject matter regarded as the invention.

I claim:

1. In a grinding apparatus including a knife holder having a slot for receiving a knife insert extending along a longitudinal axis and defining a forward edge extending outwardly of the slot, a rearward edge disposed within the slot, and inner and outer ends, the improvement comprising a beveled edge oriented non-parallel to the longitudinal axis of the knife insert forming at least a part of the outer end of the knife insert, the beveled edge being adapted for engagement by a striking tool having its longitudinal axis oriented non-perpendicular to the longitudinal axis of the knife insert for use in removing the knife insert from the slot, wherein the knife holder defines an outer end onto which the slot opens, and wherein the knife insert extends outwardly of the knife holder outer end when the knife insert is received within the slot, and wherein the beveled edge of the knife insert extends inwardly from the outer end of the knife holder into the slot.

2. The improvement of claim 1, wherein the outer end of the knife insert includes an outer edge extending rearwardly from the forward edge, and wherein the beveled edge extends between the rearward edge and the outer edge.

3. The improvement of claim 2, wherein the beveled edge is oriented at an angle of approximately 30° relative to the rearward edge.

4. In a grinding apparatus including a knife holder having a slot for receiving a knife insert extending along a longitudinal axis and defining a forward edge extending outwardly of the slot, a rearward edge disposed within the slot, and inner and outer ends, a method of removing the knife insert from the slot, comprising the steps of:

forming a beveled edge on the knife insert, the beveled edge being oriented non-parallel to the longitudinal axis of the knife insert and being located adjacent the outer end of the knife insert;

wherein the knife holder defines an outer end onto which the slot opens, and wherein the knife insert extends outwardly of the knife holder outer end when the knife is received within the slot, and wherein the step of forming the beveled edge comprises forming the beveled edge such that it extends inwardly from the outer end of the knife holder into the knife holder slot;

engaging the beveled edge with a tool such that the tool is oriented non-perpendicular to the longitudinal axis of the knife insert; and striking the tool in a direction generally along its longitudinal axis to disengage the knife insert from the knife holder slot.

5. The method of claim 4, wherein the outer end of the knife insert defines an outer edge extending rearwardly from the forward edge, and wherein the step of forming the beveled edge comprises forming the beveled edge such that it extends between the outer edge and the rearward edge of the knife insert.

* * * * *